United States Patent [19]

Lynch

[11] Patent Number: 4,826,298

[45] Date of Patent: May 2, 1989

[54] SECURITY DEVICE

[76] Inventor: Matthew A. Lynch, Flat 5, 19 Colville Terrace, London, W11 2BU, England

[21] Appl. No.: 900,097

[22] PCT Filed: Nov. 26, 1985

[86] PCT No.: PCT/GB85/00542

§ 371 Date: Sep. 23, 1986

§ 102(e) Date: Sep. 23, 1986

[87] PCT Pub. No.: WO86/03247

PCT Pub. Date: Jun. 5, 1986

[30] Foreign Application Priority Data

Nov. 26, 1984 [GB] United Kingdom ..... 8429853
Aug. 13, 1985 [GB] United Kingdom ..... 8520316

[51] Int. Cl.[4] ..... G02B 5/30; G02B 27/28
[52] U.S. Cl. ..... 350/403; 350/400
[58] Field of Search ..... 350/404, 403, 400; 361/173

[56] References Cited

U.S. PATENT DOCUMENTS 3,793,565 2/1974 Smith ..... 317/134
4,369,481 1/1983 Early ..... 361/173

*Primary Examiner*—Bruce Y. Arnold
*Attorney, Agent, or Firm*—Lowe, Price, LeBlanc, Becker & Shur

[57] ABSTRACT

A security device comprises a guide (21) provided with two polarizing screens (22) between which are placed a plurality of stacked, movable elements. Each element contains means for causing the plane of polarization of incident light passing therethrough to be rotated, the amount of rotation depending on the position of the means for rotating relative to the other elements. Setting the stacked elements to various positions results in a particular pattern of colors when light is shown through the device. This pattern can be used as an output indicator to control access to an apparatus.

5 Claims, 1 Drawing Sheet

SECURITY DEVICE

In a conventional key-operated lock, the key is shaped to move a plurality of tumblers to a selected combination of positions which uniquely allows the lock to turn. In a combination lock, the tumblers are moved to different combinations of positions by means other than a key, but only one combination of tumbler positions will allow the lock to open. In a conventional combination lock, the lock must be virtually dismantled and reassembled if the selected combination which allows the lock to turn is to be changed. When a security device which has a plurality of variable elements is used in combination with a computer, it is a relatively easy matter to adjust the selected combination of states which allows the lock to open, for example by feeding into the computer new instructions to allow the lock to open in response to a new combination of element states.

According to one aspect of the invention, there is provided a method of controlling access to apparatus comprising generating a random number, feeding input data into a security device in response to said random number, feeding output data from said security device, generated in response to said input data, to a control device, generating reference information in response to said random number generated and allowing access to said apparatus when the output data corresponds to said reference data.

In one arrangement, the security device comprises a plurality of relatively movable elements which can be moved to any of a plurality of combinations of positions, said input data comprising instructions to move respective elements to respective positions, each said element varying the plane of polarization of light passing through it according to its position, said output data being dependent on the colour of light emerging through all of said variable elements and a pair of polarizing screens.

According to another aspect of the invention there is provided a security device comprising a plurality of elements, each movable to any of a plurality of positions and each causing rotation of the plane of polarization of light passing through it by an amount depending on its position, the device comprising a pair of plane polarizing screens mounted one on either side of the plurality of elements, such that the colour of light having passed through the screens and elements depends on the positions of the elements relative to the screens. By moving the elements to a different combination of positions, different colours can be generated. If the elements have different thicknesses at different zones across the width of the screen, then the colours of the light emerging from different zones will also be different. By feeding input data into the security device in the form of instructions as to the position of each element, output data can be derived in the form of the colour or a combination of colours of the light emerging from the screen when white light is shone upon the device.

An example of the invention will now be described with reference to the accompanying drawings, in which.

Figure 1:
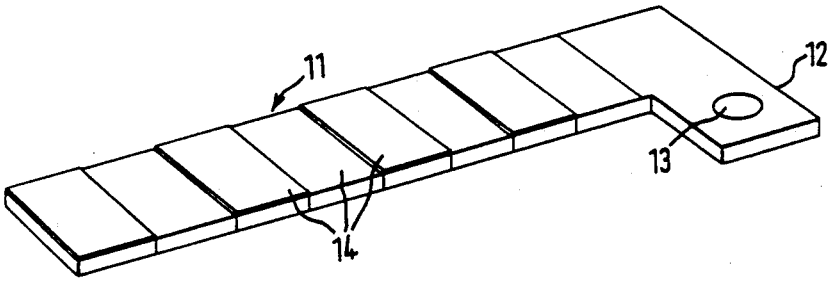
FIG. 1 is a perspective view of an element of an encoding device.

The element of FIG. 1 comprises a backing strip 11 of uniform cross section formed of toughened polyvinyl chloride (pvc) with a handle 12 at one end bearing a label 13 identifying the element. A plurality of equal sized zones 14 are located along the strip. Each zone may be provided with a covering layer which rotates the plane of polarization of light passing through it by an angle depending upon its thickness. Some coatings have a preferred plane of polarization so that the light passing through it is affected not only by the thickness of the coating but also by its preferred plane of polarization. The Figure shows eight zones 14, each with a coating of polyethylene whose thickness has a selected constant value between nil and a maximum value.

Figure 2:
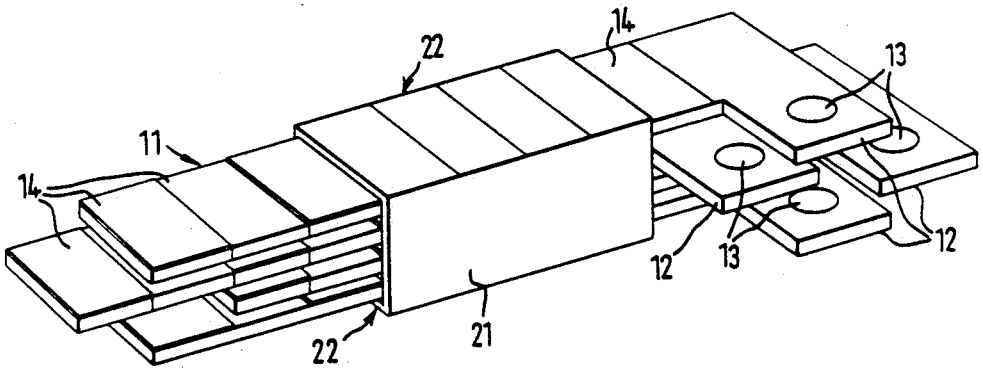
FIG. 2 is a perspective view of an encoding device with four such elements.

FIG. 2 shows four such elements mounted in a linear guide 21 formed between two polarized screens 22 whose planes of polarization are in this arrangement mutually at right angles. Each screen extends in this arrangement across four zones on the elements. In this arrangement, the top element is in position 2, with one zone extending beyond the right hand end of the guide 21, the next element in position 3, the next element in position 4 and the bottom element in position 2. When white light is shown through the screens with the four elements in this combination of positions, the light emerging at each zone will have a colour which depends on the thicknesses of the coatings on the four elements aligned at the zone and the directions of the preferred planes of polarization of the coatings and the directions of the planes of polarisation of the screens. The four colours can be used as output information for the security device, to be read in any desired way.

The guide 21 need not be linear. The elements could for example be circular with sector shaped zones, the guide allowing relative rotation of the elements.

The device can be used as follows: A computer generates a number in a random fashion. The number is used to display to a user the positions (1–5) to which he should move each of the four elements on his security device. At the same time, the computer will generate from the same number reference data whose use will be explained later. Having set the security device to the positions instructed by the computer display, the user will see four colours across the screen when he views the security device against white light. He will key into the computer these four colours which the computer will compare with the reference data. If the comparison is correct, the computer will enable access to apparatus. If the user is attempting to use an incorrect security device, the colours he views will be different, and on performing the comparison, the computer will register an error in the comparison and will not enable access to the apparatus. Several attempts may be allowed by the computer, after which it shuts down.

The actions of the operator could be dispensed with if the device is placed in a reader operated by the computer. The reader moves the elements of the device in accordance with instructions derived from the random number and then reads (for example by colour sensitive photocells) the colours generated by the device in order to perform the comparison.

Since it is difficult to analyse the polarization rotating properties of the elements of the security device from their physical measurements, the described security device is difficult to copy, so that unauthorised access to the apparatus is difficult to achieve.

Thus the invention prevents an unauthorised user, or anyone else for that matter, from writing down the colour combination required to operate the apparatus. Therefore, even if someone has worked out the algorithm on which the computer functions, the colour code cannot be ascertained, so again preventing operation of the apparatus.

I claim:

1. A security device comprising:

a plurality of stacked elements, each movable to any of a plurality of positions relative to the others; means carried by each element for causing rotation of the plane of polarization of incident light passing therethrough by an amount depending on its position relative to the other elements; and a pair of plane polarizing screens mounted one on either side of the stack of elements such that the color of light having passed through the screen and elements depends on the positions of the elements relative to the screens and relative to each other.

2. A device as claimed in claim 1 wherein each element comprises a plurality of zones, each causing rotation of the plane of polarization of light passing therethrough by a predetermined amount.

3. A device as claimed in claim 2 wherein said screens extend across a plurality of said zones.

4. A device as claimed in claim 2 wherein each zone has a predetermined thickness.

5. A device as claimed in claim 1 wherein each element comprises a backing strip and a coating.

* * * * *